United States Patent [19]

Andrews

[11] 4,125,354

[45] Nov. 14, 1978

[54] OVEN HEAT EXCHANGER

[75] Inventor: David M. Andrews, Ivyland, Pa.

[73] Assignee: Aztec Machinery Company, Inc., Ivyland, Pa.

[21] Appl. No.: 770,623

[22] Filed: Feb. 22, 1977

[51] Int. Cl.[2] ..... F23D 11/44

[52] U.S. Cl. ..... 431/11; 126/19 R; 126/21 A; 431/167

[58] Field of Search ..... 431/167, 166, 11, 207, 431/242; 126/77, 146, 19, 21, 21 A, 273

[56] References Cited

U.S. PATENT DOCUMENTS 3,194,215 7/1965 Barnes ..... 431/167

3,476,368 11/1969 Saiki ..... 431/167 X

*Primary Examiner*—Edward G. Favors

*Attorney, Agent, or Firm*—Robert J. Mooney

[57] ABSTRACT

An industrial process oven is provided with a false outer skin spaced from the oven wall. A plurality of air currents are induced and established in a like plurality of air passages provided between the oven wall and the outer skin. As ambient air passes over the oven wall it is preheated. The preheated air from the plurality of air passages is collected in a transfer duct and conveyed to an oven heater where its temperature is further raised to a desired operating temperature.

3 Claims, 3 Drawing Figures

OVEN HEAT EXCHANGER

BACKGROUND OF THE INVENTION

This invention relates to means for preheating air that is ultimately raised to a higher operating temperature for use in an industrial processing oven and in particular with means to induce a confined air current over a heated surface to effect a heat exchange between the heated surface and the air current.

There are classes of industrial processing ovens which are exceptionally large and use enormous amounts of fuel to heat air to relatively high operating temperatures for use, within the oven. Some of these ovens have cross-sectional areas at least as large as 8 feet by 14 feet and lengths which may exceed 75 feet. The walls of these ovens are typically manufactured in sections or panels which are joined together to form the oven enclosure. Each section typically consists of two spaced apart metal plates with insulation inserted between the plates. Even though the oven walls are insulated, large amounts of heat are lost through the oven walls. This wasted heat raises the temperature of the outer oven wall to undesirably high levels and can create a safety hazard to operating personnel. In addition, the work area in the vicinity of the oven can become oppressively hot making it uncomfortable for personnel to work in the area. Even more importantly, the heat loss, in effect, represents uneconomic utilization of fuel.

Accordingly, it is an object of this invention to provide an industrial oven with means to induce and establish a confined air current in a plurality of air passages to effect a heat exchange between the heated outer surface of an industrial processing oven and the air current to thereby preheat ambient air to higher temperatures. It is a further object of this invention to provide said oven with a false outer skin which is spaced from the heated outer oven wall to thereby provide said confined air passages. It is a further object of this invention to provide an industrial oven which may be safely touched, which preheats ambient air to thereby reduce fuel consumption, which permits reduced use of oven insulation, which is prefabricated in sections to reduce assembly time and which utilizes otherwise lost heat. These and other objects are achieved as follows.

SUMMARY OF THE INVENTION

A processing oven is provided with a false outer skin which is spaced from the insulated walls of the oven so as to create an air space between the outer skin and the oven walls. Air inlet ports are provided in the lower portion of the outer skin. Transverse air ducts, which pass through the insulated oven walls, are provided in the upper portion of the oven walls. The transverse air ducts communicate with a transfer duct located within the processing oven. The transfer duct terminates in a fan within an air heater unit. The fan induces air flow into the air inlet holes, thence upward between the false skin and the oven walls, thence through the air duct in the oven wall, and thence through the transfer duct into the air heater unit where it is raised to the desired operating temperature for the particular process performed by the oven. The heated air is then discharged into the processing oven to be used therein.

The ambient air is preheated as it passes up and through the air space between the oven walls and the false outer skin. As the now preheated ambient air enters the transfer duct, its temperature is further raised during its passage along the transfer duct. In this way temperature of the ambient air is raised a significant amount before it reaches the heater unit where its temperature is further raised to the desired operating level. The preheating is accomplished by using the heat that would otherwise escape through walls of the oven were it not for the false outer skin and by placement of the transfer duct within the oven proper.

Since there is normally a great difference between a desired operating temperature in an oven and the temperature of ambient air, any preheating, which employs waste heat, results in fuel cost savings since less fuel is required to raise preheated ambient air to an operating temperature than is required to raise ambient air to an operating temperature.

Other objects, advantages, and novel features of the invention will become apparent from the following detailed description of the invention when considered in conjunction with the accompanying drawings.

DESCRIPTION OF THE PREFERRED EMBODIMENT

Figure 1:
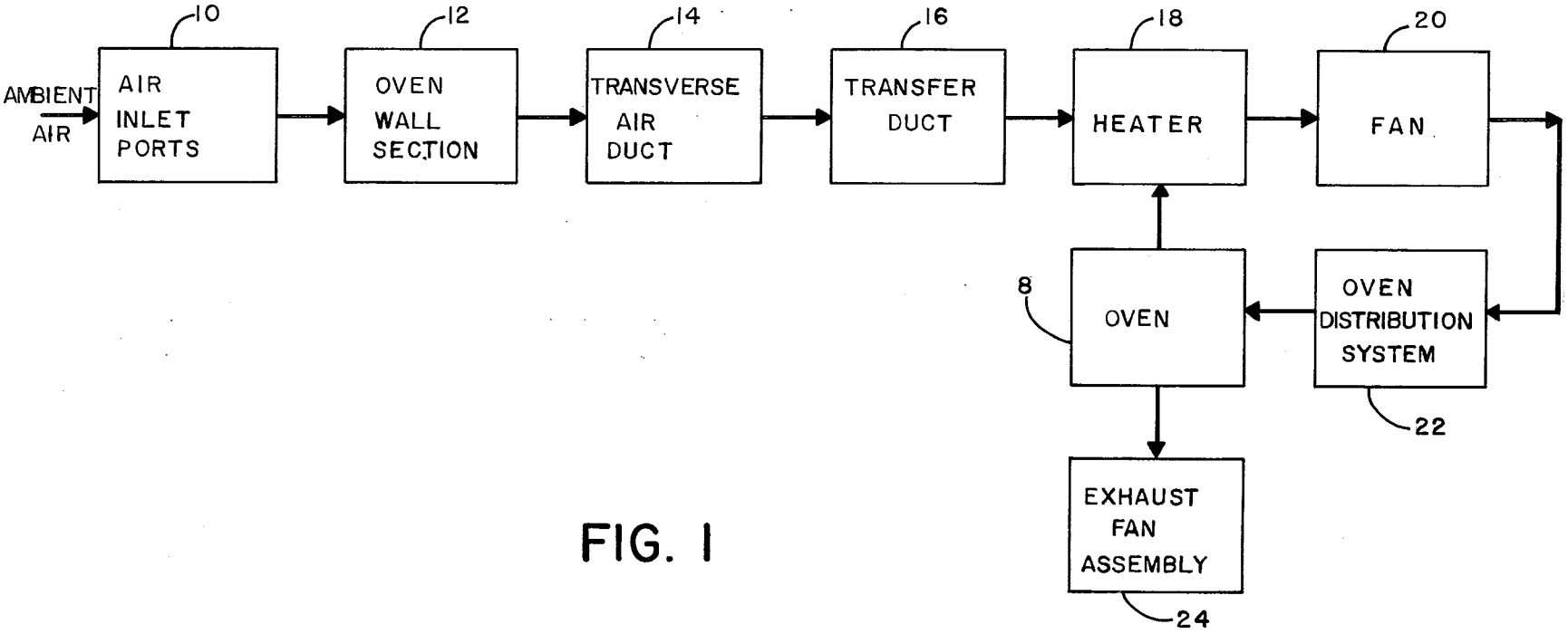
FIG. 1 is a block diagram illustrating the flow of air into and through the oven and further illustrating the air flow through the air preheating heat exchanger device of this invention.

FIG. 1 is a block diagram illustrating the flow of air into and through a standard industrial oven air recirculating system and further illustrates the air flow through the air preheating heat exchanger device of this invention. Ambient air enters each one of a plurality of air inlet ports 10. The ambient air passes over the surface of each one of a plurality of oven wall sections 12 and as it does so it gathers heat from the hotter oven wall sections 12. Thereafter, the now preheated air passes through a transverse duct 14 located near the top of each oven wall section 12 and enters a transfer duct 16 located within the oven 8. The transfer duct 16 conveys the preheated air to a standard heater 18. (It should be noted that the temperature of the preheated air is further raised during its passage through the transfer duct 16). The standard heater 18 raises the temperature of the now preheated air to a desired operating temperature. A standard fan 20 draws the heated air from the heater 18 and injects it into any one of several standard oven air distribution system 22. The air distribution system 22 is located within the oven and delivers the heated air to the product being processed within the oven 8. Part of the heated oven air is returned to the heater 18 and the remainder is exhausted from the oven 8 by a standard exhaust fan assembly 24.

Figure 2:
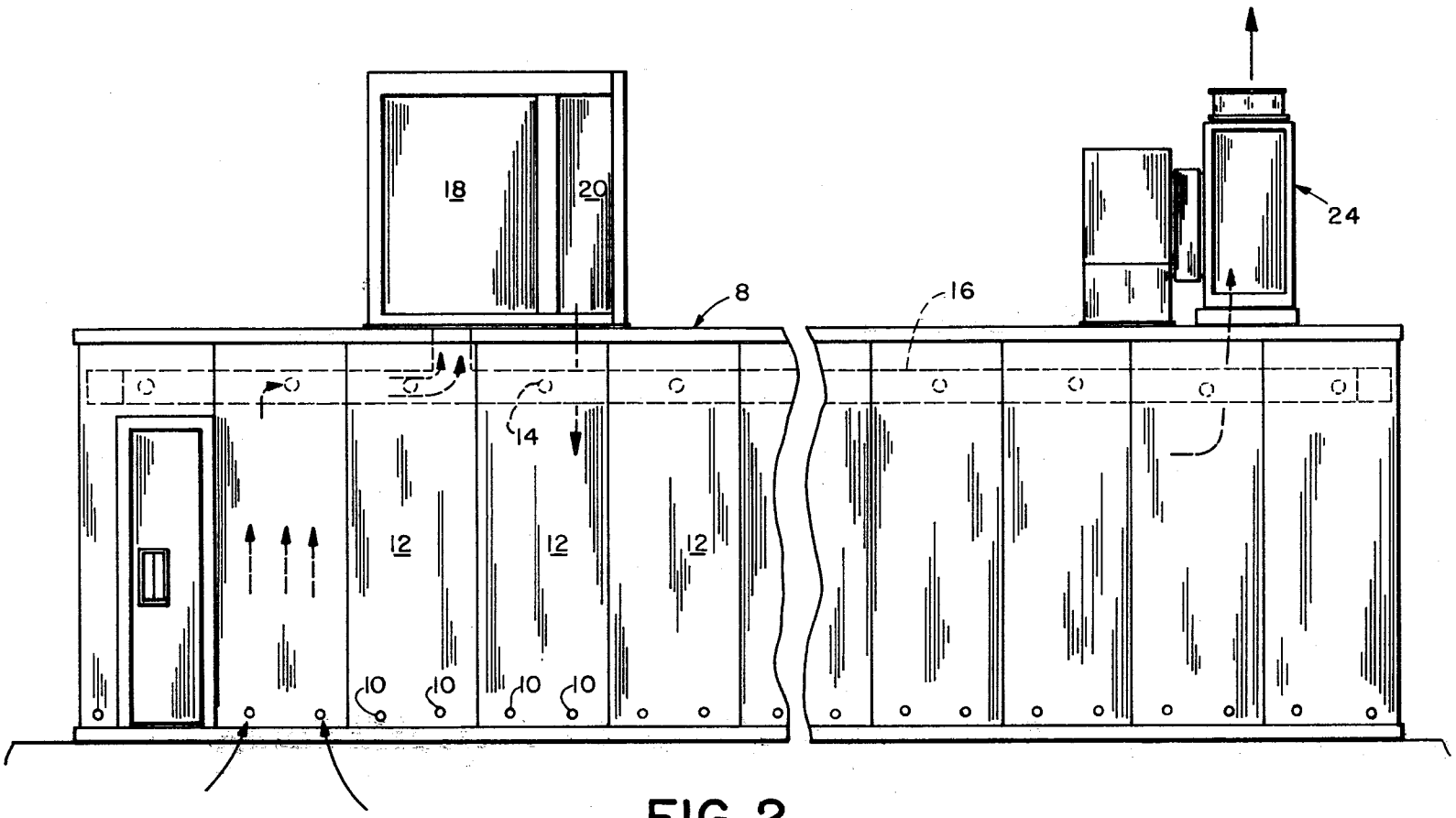
FIG. 2 is a front elevational view partially broken, illustrating a multi-paneled oven construction incorporating the preheating heat exchange device of this invention.

With reference to FIG. 2, the industrial processing oven 8 is constructed in the form of a closed structure. The walls of the oven 8 are composed of a plurality of interconnected panels or sections 12. The heater 18 and exhaust fan assembly 24 are situated on the roof of the oven 8. Air communication between the oven 8, heater 18, oven air distribution system 22 and the exhaust fan assembly 24 is established with standard ducting, not shown. The fan 20 is adjacent the heater 18.

Figure 3:
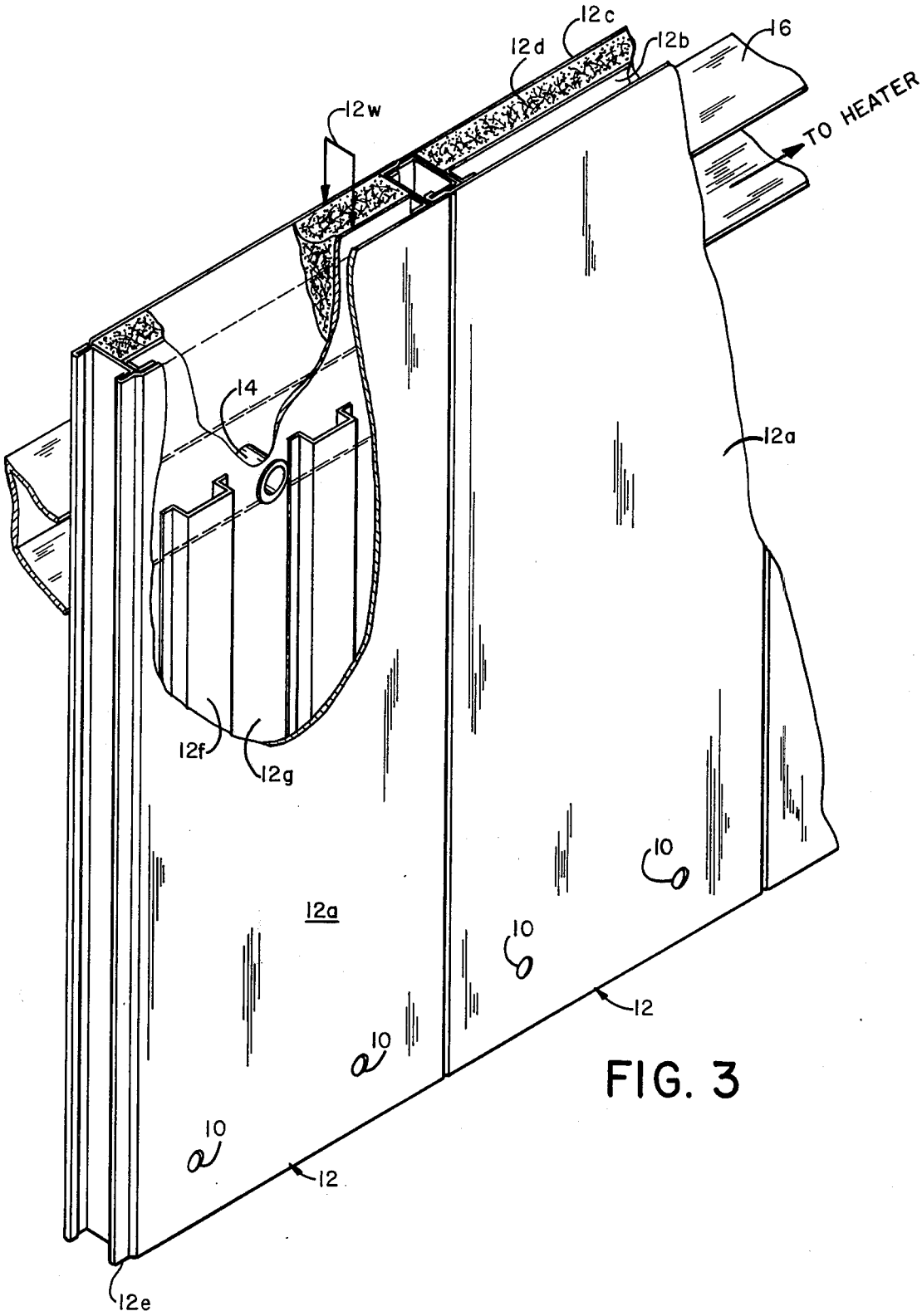
FIG. 3 is a partially sectioned isometric view of several interconnected panels illustrating the heat exchanger of this invention.

With reference to FIG. 3, each wall section 12 includes a metallic false outer skin 12*a* connected to and spaced from an oven wall 12*w* which includes two metallic sheets 12*b*, 12*c* separated by standard high temperature insulation 12*d*. The two metallic sheets 12*b*, 12*c* are connected to the false outer skin 12*a* along the vertical sides to form a compact easily installable oven wall section 12. Male and female flanges 12*e* on the vertical sides of the wall sections 12 allow inter-connection of the sections 12 by bolts or other suitable means, not shown. Hat sections 12*f* space the false outer skin from the outer metallic sheet 12*b* give the skin 12*a* a certain rigidity and resistance to buckling. The outer skin 12*a* and the metallic sheet 12*b* form a confined air passage 12*g*.

At least one, but preferably two, air inlet ports 10 are located in the lower portion of the outer skin 12*a* of each of the plurality of oven wall sections 12. A transverse air duct 14 passes through the two metallic sheets 12*b*, 12*c* and the intervening insulation 12*d*. The transverse air duct 14 is located in the upper portion of the oven wall 12*w* of each wall section 12. The transverse air duct 14 establishes communication between the air passage 12*g* and the transfer duct 16. Each of the plurality of transverse ducts 14 dumps air into the transfer duct 16 located within the oven 8. The transfer duct 16 conveys the now preheated ambient air to the heater 18 where its temperature is further raised to a desired operating temperature.

Although the air preheating heat exchanger shown herein has been disclosed as part of an industrial oven, it should be clear the heat exchanger concept can be applied to a wide variety of ovens including those commonly found in the home to effect air preheating and/or cool external skin temperatures.

For clarity of presentation only one side of the oven 8 has been shown in FIG. 2. However it is to be understood that all sides of the oven are constructed in accordance with the teachings of this invention. The inventive construction may also be extended to the top of the oven 8. The ambient air need not be taken from the area immediately adjacent the oven but may be taken from outside the building in which the oven 8 reposes and may be conveyed through ducts (not shown) to the air inlet ports 10.

Typical oven processes include, but are not limited to, drying, curing and cooking. A typical operating temperature within the oven 8 is approximately 450° F.; typical ambient air temperature is approximately 75° F. With an interior oven temperature of approximately 450° F., the exterior sheet 12*b* reaches a temperature of approximately 125° F. As the ambient air passes over the exterior sheet 12*b*, its temperature is raised 30° to 40 or more degrees over its nominal temperature of 75° F.

I claim:

1. A method of raising the temperature of a fluid by using the normally wasted heat emanating from the normally hot walls of an oven having a heat source comprising:

enclosing said walls with a closure spaced from said walls so as to create a confined fluid passage;

providing said closure with a plurality of fluid inlet ports;

providing said walls with a plurality of fluid ducts vertically offset from said plurality of fluid inlet ports;

providing a transfer duct within said oven to establish fluid communication between said plurality of fluid ducts and said heat source, and providing means for establishing fluid flow into said fluid inlet ports, through said confined fluid passage and from said fluid ducts into said transfer and to said heat source.

2. An ambient air preheating device for an industrial process oven, which oven is provided with metallic walls and a heater, said device comprising:

a metallic skin attached to and spaced from the exterior of said metallic walls to thereby define an air passage;

a plurality of air inlet ports, each of which is located in the lower end of said metallic skin and each of which allows ambient air to have access to said air passage;

a transfer duct situated within said oven and secured to the interior of the metallic walls of said oven;

a plurality of air ducts each of which passes through the metallic walls of said oven and each of which is located above each of said air inlet ports and each of which air ducts allows fluid communication between said transfer duct and said air passage; and means for establishing air flow from said plurality of air inlet ports, through said air passage and said plurality of air ducts, to said heater.

3. An ambient air preheating device according to claim 2 wherein said metallic skin comprises a plurality of interconnected metallic sections each of which defines a distinct air passage and wherein each of said sections is provided with at least one of said plurality of air inlet ports.

* * * * *